US005311629A

United States Patent [19]

Smith

[11] Patent Number: 5,311,629

[45] Date of Patent: May 17, 1994

[54] DECK REPLACEMENT SYSTEM WITH IMPROVED HAUNCH LOCK

[76] Inventor: Peter J. Smith, 157 Parkhurst Rd., Gansevoort, N.Y. 12831

[21] Appl. No.: 924,200

[22] Filed: Aug. 3, 1992

[51] Int. Cl.[5] ..... E01C 7/00

[52] U.S. Cl. ..... 14/73.1; 404/49; 52/585.1

[58] Field of Search ..... 14/6, 73, 73.1; 52/251, 52/259, 583, 585, 296, 299, 698, 723; 264/35, 274, 275, 277; 404/35, 40, 45, 70, 49

[56] References Cited

U.S. PATENT DOCUMENTS

| | | | |
|---|---|---|---|
| 2,162,742 | 6/1939 | Nagin | 14/73 |
| 3,253,289 | 5/1966 | Nagin | 14/73 |
| 3,260,023 | 7/1966 | Nagin | 14/73 X |
| 4,653,962 | 3/1987 | McKittrick et al. | 405/286 |
| 4,963,056 | 10/1990 | Cihal | 14/73.1 X |
| 4,972,537 | 11/1990 | Slaw, Sr. | 14/1 |
| 4,977,639 | 12/1990 | King | 14/73 |
| 4,991,248 | 2/1991 | Allen | 14/73 |
| 5,025,522 | 6/1991 | Eskew et al. | 14/73 |

FOREIGN PATENT DOCUMENTS

| | | | |
|---|---|---|---|
| 1379397 | 3/1988 | U.S.S.R. | 14/73.1 |

*Primary Examiner*—Timothy V. Eley

*Attorney, Agent, or Firm*—Schmeiser, Morelle & Watts

[57] ABSTRACT

An improved article and method for making and installing a bridge deck replacement system. Subsystem articles include a plurality of precast slabs which contain features, notably projections and plates which depend from the underside thereof, which are used to form both haunch forms/molds and grout engaging devices. When used in conjunction with the conventional and preestablished supporting structure subsystem, the slabs, though use of the various devices included and/or depending therefrom, non-shrink grouting and the improved method of installation, are securable thereto and, yet, may be severally and/or discretely removed at a later time and replaced with new slabs. The replacement facility is obtained concomitant with the attainment of an overall system having a truly composite action in that slabs and support structure subsystems function as a singular unit.

7 Claims, 3 Drawing Sheets

DECK REPLACEMENT SYSTEM WITH IMPROVED HAUNCH LOCK

BACKGROUND OF THE INVENTION

1. Field of the Invention

This invention relates generally to the field of prefabricated structural members and, specifically, to structural slabs which are used as surface and bridge deckings that are attachable to, and removable from structural inposts and supports such as steel beams or girders. The methods and articles of this invention include methods for prefabricating slabs, the articles themselves containing novel attachment means, and methods for acquiring a physical coupling of these slabs to supporting beams or girders.

2. Description of the Background and Relevant Art

It has been common in the road and bridge construction industry to build roadway surfaces and bridges by use of (concrete) deck slabs that have been cast in situ and are used to span, and are supported by, other structural steel or concrete supports girders. Improvement to the above method has been had by attaching the slabs in a manner by which they cooperate structurally with the supporting members. This improvement is termed "composite construction" and has proven to increase the efficiency and effectiveness of the supporting members. The cast in situ method of bridge deck construction, with all of its advantages, carries with it some significant disadvantages. One such disadvantage is that the method requires a great deal of time in order to build forms, pour and cure the concrete. Another obvious disadvantage is that field conditions such as inclement weather, make it difficult to achieve a high degree of quality, durability and expediency.

Precast concrete slabs have long been viewed as desirable elements to use in bridge deck construction. Such slabs are generally prefabricated off-site, under factory controlled conditions, and result in the production of high quality concrete decks. Since they may be generally produced well in advance of the use requirement, they may be stock-piled and prepositioned at the site of construction. During actual roadway/bridge construction with the precast concrete slabs, traffic time is interrupted only for a relatively short period while the deck units are placed into position.

Slab interconnection does not prove as great a problem as connection of the slab to the underlying structure. Where the slabs or deck portions (if gratings rather than slabs are used) have had extensions or protrusions from the margins thereof, connection means are not a problem. As early as 1939, U.S. Pat. No. 2,162,742, was issued to H. Nagin for a flooring construction. Nagin taught a metal grid structure which was used as deck surface for a bridge. He showed the use of (elongate) thin metal (strips) plates to construct a form for a grout receiving region atop an underlying girder. Although it did not appear to be Nagin's intent to provide a form for grout which would effect actual connection between the deck sections, his formation of a grout receiving area presaged the modern use of grout to provide support and mechanical coupling between deck slabs or gratings and the supporting structure. Further to Nagin's credit was the use of metal strips, slotted to fit between grid stringers, to form the sides of the grout receiving mold. The strips are held by friction and thus are not rigidly attached (nor attachable), to the grid or deck. Unfortunately, Nagin went no further with the grout form of his disclosure and it would appear to have little application to today's precast concrete or composite slab. Further, the Nagin grouting concept did not entertain use of the grout as a support for the deck system and a means for securing the deck slabs to the underlying support structure. Thus, a cost-effective, structurally sound and versatile method of attaching slabs to supporting members has been a long-sought goal in the construction industry.

Many methods of attachment have been devised for securing bridge deck slabs, in particular, to underlying support structures. These methods range from simply bolting the slabs to the girders to more sophisticated welded type connectors. King, in U.S. Pat. No. 4,977,636 teaches a bridge support system in which a cap member is used in combination with a temporary base support surface to form an enclosed area between a bridge deck and a support column. The enclosed region inwardly receives reinforcing rods and is eventually filled with concrete as it is poured over the deck structure. Thus, the deck structure or slab members are actually an underlayment and would not themselves serve as a traffic-contacting road surface. Yet, the King teaching clearly provides a non-adjustable haunch region that is a corollary of the earlier Nagin art. In this instance, however, the original deck slabs (underlayment) are physically coupled to their supporting structure and each other by a continuous concrete extension of the roadway surface. Significant disadvantages are realized in the King embodiment in that: firstly, a special support surface form must be constructed to receive the concrete; and secondly, some of the support surface must be removed thereafter.

A patent issued to Slaw, Sr., U.S. Pat. No. 4,972,537, disclosed, in late 1990, a composite prefabricated deck panel and a method of construction therefor. Slaw, Sr. discloses the use of metal connecting rods to secure prefabricated deck panels to an underlying support structure. Haunch type enclosed areas are formed between the underside of the panels and the top of each of several girder support members. Located within each enclosed area is a plurality of metal connectors. Once the panels are properly positioned, grout is pumped into the enclosed areas to permanently secure the panels to the support members. According to the Slaw, Sr. teaching, the sides are preformed in the deck sections and rest atop a girder with a flexible seal therebetween. Nonadjustable, preformed concrete shoulders serve as the sides of a haunch mold and depend from the deck panels proper. As in the case of King, Slaw, Sr. does not provide, in the prefabricated panels, a means for acquiring an adjustable haunch mold. Instead, the aforesaid concrete shoulders rest ontop the supporting girder or beam and require a seal therebetween in order to ensure containment of the grout that is to be pumped into the haunch region.

Final to this discussion of relevant art is the patent issued to Eskew et al. in mid 1991, U.S. Pat. No. 5,025,522. Essentially, these patentees teach a bridge deck panel support system and method for supporting precast bridge deck panels on a bridge girder. The deck panels are initially supported through a grout layer that is located between the bottom of the panel and the top of the structural support member. An elongate anchor plate atop, and partially girdling, the beam top surface bears an ascending flange, termed "a plate", by Eskew et al., and which, on each side thereof, anchors a grade bar. A continuous seal between the grade bar completes, with a grout filler (placed between the bar and beam), an enclosure or haunch region that is to be filled with concrete. An alternate embodiment eliminates the grade bar and uses the ascending plate or flange member only. Once the panel members have been properly positioned, they rest on a seal means placed between (preferably) the grade bar and the undersurface of the panels. Concrete from an overlay then fills the enclosed (haunch) area between the adjacent plate members and their support. As with the preceding art, a most notable disadvantage of the Eskew et al. teaching is the lack of an easily made mold or form that may be used to create a haunch region that is defined by the top surface of the support member (girder), adjustable form sides and the overlaying and haunch filling with concrete.

Some of the aforesaid attachment methods have been successful from an attachment standpoint, but most, if not all, methods have failed to provide a method of attachment which allows the top or the bottom of the panel to be attached to match a predetermined grade or elevation. To compensate for this deficiency, a concrete topping is generally poured over the slab to provide a uniform surface which meets predetermined grade and elevation requirements. This cast in situ topping requires a significant amount of cure time before the structure may be used.

Additional to the aforementioned grading problem, most of the previous attachment methods have also failed to allow the slab and structural support member to act cooperatively as a composite structure. Some methods do achieve partial composite action, as may be seen in the discussion of relevant art; but, they fail to adequately convince bridge construction engineers that full composite action is developed. In compensation for this deficiency, larger structural support members are currently being used. Still, a further disadvantage of presently used support systems is recognized in relation to the structural supporting members themselves. These members deflect significantly when loads are placed upon them and their final geometry is not realized until all of the precast slabs are situated in final position. Thus, the top surface of the structural supporting members, and therefore the surface of the tops of all of the slabs, is not defined until all of the slabs have been placed on the structural members. I am unaware of any modern and reliable system that offers postplacement adjustment of the tops of the slabs (roadway surface) to the proper elevation.

SUMMARY OF THE INVENTION

I have overcome the aforementioned disadvantages by providing an improved method for attaching precast slabs to supporting structural members, a system which is cost effective and easy to use. The slab subsystem is precast, easily attached and provides positive composite action in conjunction with the support subsystem. Discrete precast slabs are easily adjustable to the correct (desired) elevation before it is finally fastened in place by a coupling to a support member and/or an adjacent slab; and, when the time comes to replace the slabs, or a discrete slab, my system allows for easy slab removal from the supporting structural member(s).

Slabs are individually precast, away from the assembly site, preferably in a rectangular or square shape and upside-down relative to the finished orientation in a bridge or roadway structure. Various reinforcement bars and brackets may be used so as to effect the placement of at least one adjusting screw in each corner of the generally rectangular shaped slab. On the underside of each slab (upper surface during the molding or casting procedure), there is disposed a strip-like region running transverse the slab from one margin to the opposite margin. This region is demarcated by either two rows of bolt holes or a set of slotted voids running parallel to each other between the aforesaid margins. Two elongate, right-angled, "L" shaped plates are bolt-mounted in the parallel slots or bolt holes so that the shorter (if any) leg of the plates are mounted flush to the underside surface of the slab and oriented outwardly of the demarcated region. Further, these surface-mounted legs are transversely slotted so that the plates may be adjusted inwardly and outwardly of the same region. The longer legs of the plates depend perpendicularly downward of the slab underside and are parallel to each other, forming with the surface of the slab a three sided form or containment geometry. Final to the slab definition, there are encasted also a plurality of protruding mechanisms that depend downwardly of the slab (in proper, operational orientation) and that are exposed within the aforementioned region, which I define as a haunch (which is the shoulder portion of an arch or cap located principally between the apex and the inpost regions).

The support beams or principal supporting structure which is used with my improved slab geometry is conventional and otherwise unremarkable. Mostly of the I-beam type, there is the requirement that such support surfaces have protruding (vertically) upward, from the top contact surface, a plurality of studs. These studs are conventional and are generally installed in the field. Irrespective of the situs of installation, their placement must be such as to not interfere with the encasted protrusions from the slab at the haunch area, when the slab is superposed over the support structure top, which is encircled by the haunch plates. Once this posture is effected, the haunch becomes totally and peripherally enclosed and the only ingress thereto/from is through a series of orifices in the slab which pass from the slab top surface through to the underside, and into the haunch region. It is through these orifices that grout, under considerable pressure, is forced into the haunches so that, upon solidification of the grout, a rigid and permanent mechanical coupling is effected between the slab and the support structure via the encasted slab protrusions and the projecting support surface studs. The grout filled haunch also provides a firmament between one or more slabs and the support structure to effect the aforesaid positive composite action of the total system.

Before the grout is actually inserted to complete the finished system, individual slabs may be adjusted by turning the adjusting screws so as to obtain a uniform deck or roadway surface. Adjusting bolts or screws are not new to this construction industry; however, to my knowledge they have not been used before in the combination that I employ in my slab subsystem. These bolts/screws allow all of the dead load of the slabs to be placed on the girders before final adjustment for grade. This means the surface and orientation of the slab attained at adjustment time will be the same surface existing in the final product. After the grout has fully cured throughout the system, the leveling screws/bolts may be removed and the remaining holes filled with fresh grout. Thereafter, if desired, an overlayment of another surface such as asphalt, concrete or other composition may be made.

As the reader may now deduce, my method for connecting precast slabs to a support structure is a considerable improvement over current techniques. It comprises the steps of preparing a slab by precasting it, generally topside-down so that the denser aggregates will accumulate over the operational topside region of the slab, encasting, by the slab pouring, the aforementioned projections and the haunch-forming adjustable plate adjusting and capturing mechanisms, positioning the slab relative to a girder, so that the slab haunch region superposes and partially encircles the girder top surface, leveling the slab as desired by use of the included adjusting screws and finally filling the haunch region with a grout by passing the grout through several orifices in the slab which communicate with the haunch region. Closure of haunch ends is done by conventional formmaking.

Having presented this general overview of the bridge deck replacement system, the reader is referred to the following description of drawings and system details for further instruction in my invention.

DETAILED DESCRIPTION OF THE PREFERRED EMBODIMENT

Figure 1:
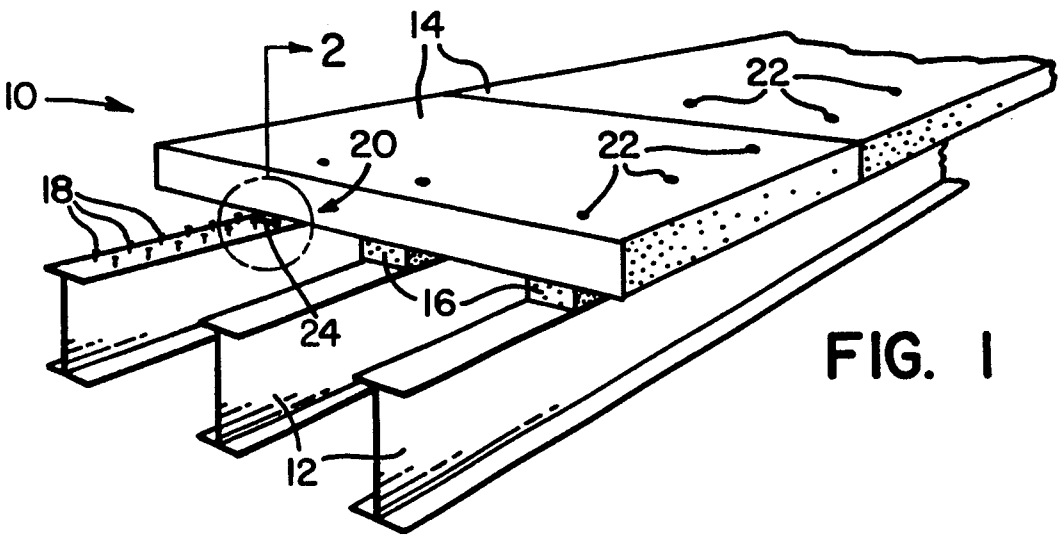
FIG. 1 is an isometric illustration of the basic components of the bridge deck replacement system.
Figure 2:
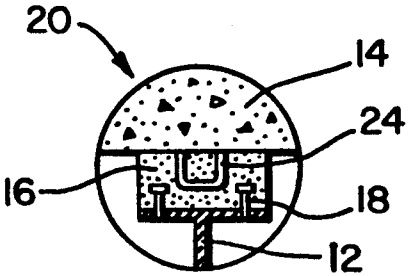
FIG. 2 is a cross section of the detailed area encircled in FIG. 1.

Referring particularly to FIG. 1, several salient elements of the invention 10 are depicted in isometric illustration. Most prominently featured are the girders 12, representative of an underlying supporting structure, slabs 14 and grouted haunches 16 disposed between the slabs 14 and the top surfaces of the girders 12. Ascending vertically from the girder top surface of the furthermost structural member is a series of short projections, termed bolts 18. Descending from the underside of the slabs 14 are many of (prospective) grout-engaging devices 24, herein a slab encased reinforcing bar which protrudes from the underside of the slab as a hook or U-shaped device. Greater detail 20 of the aforesaid devices is depicted in FIG. 2. Of FIG. 2: it is representative of the detail 20 in FIG. 1 and depicts in cross-section, the slab 14, the hook or U-shaped protrusion 24, the grout haunch 16, as it encases the hook 24, and the girder's 12 ascending projections/bolts 18. As mentioned earlier, I prefer to cast concrete slabs, or any compositional slab, in the upside-down or topside-down mold orientation because the denser aggregate tends to accumulate in the region that will later serve as the upper or traffic-contacting surface of the slab. Although an overlayment such as asphalt is oftentimes desired, my invention deals conceptually with the use of the finished slab 14 as the exposed, traffic-contacting surface. Such a usage certainly facilitates discrete removal of slabs for bridge deck or roadway repair.

Figure 3:
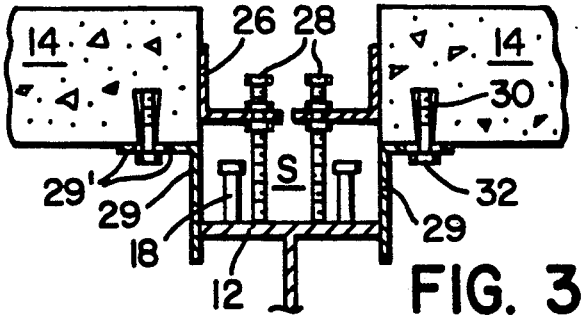
FIG. 3 is a cross sectional illustration of adjustable screw supports located at the end of a slab.

Details not discernable in the preceding drawings are now depicted in FIG. 3 et. seg. More particularly, at FIG. 3, there is depicted two abutting slab margins or ends equipped with adjustable screw support mechanisms 26/28. Mounting brackets 26 are deeply embedded in the slab 14 and the adjuster screws or bolts 28 are located at the extreme projecting end of the brackets 26. As may be seen in this illustration, the slab weight, on a support, is borne by the screws 28. The use of such adjusting screws is known in the industry, however, and the most salient factors seen in FIG. 3 comprise the elements 26,29,30,32, which create or establish the mold in which the invention's haunch 16 will be formed. As mentioned in the preceding Summary, the haunch is a grout casting which serves to join the slabs to the support structure by acting as a physical coupling mechanism between the two subsystems (deck slabs and supporting structure). It is this coupling that effects the desired composite action of which I spoke earlier in this disclosure. Thus, in FIG. 3, slab-peculiar elements are detailed: parallel slots or anchor holes 30 are formed in the underside of the slab into which will be fitted a plurality of bolts 32. The bolts have the function of fixedly securing haunch mold sides, i.e., angle irons 29 which run parallel and (in this instance) flush with the edges of slabs 14, along the entire margins thereof. These right-angled or L-shaped plates are termed throughout by the latter designation and form the sides of the mold which is used to create a haunch region S. The bottom portion of the form, which like the relevant art discussed in an earlier section of this disclosure, is the actual supporting structure 12 and will not be removed. It may be seen clearly how the slab haunch region S is superposed over the girder 12 top surface. The sides of the haunch mold 29 comprise the downwardly depending plates which are adjusted to snugly abut the girder 12 by moving them inwardly of the haunch region S along transverse slots 29' while passing under the bolt 32 heads. The reader should note here that many disadvantages of the earlier discussed relevant art are overcome by the instant invention, notably in that I have eliminated the permanent, nonadjustable haunch mold elements and, since the plates 29 have no other function after the haunch is filled with grout and cured, there is no actual physical contact between the slab 14 and the underlaying support structure 12. Clearly, the slab 14 will remain coupled to the support structure 12 by the fact that brackets 26 will cooperate, through the grouted haunch 16 in unison with support 12 bolts 18, to acquire the requisite (true) composite action. As detailed earlier, the adjusting screws 28 may be removed, after the grout has cured, and holes formed thereby may be refilled with similar non-shrink grout such as CHRYSTEX (TM).

Figure 4:
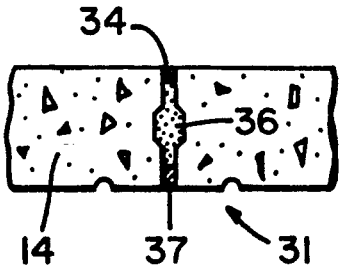
FIG. 4 is a slab joint detail illustration.
Figure 5:
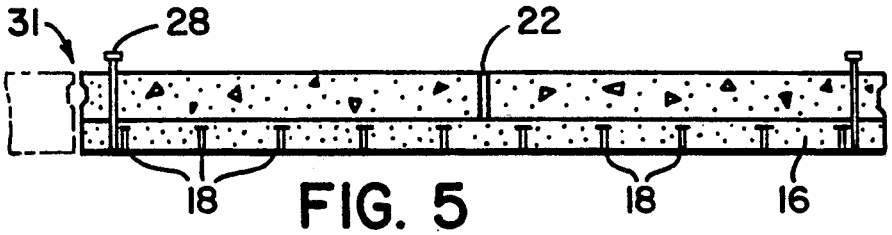
FIG. 5 is a cross sectional illustration of depicting the haunch and adjusting screws.

FIGS. 4 and 5 are joint detail 31 and elevational cross-sections, respectively, of earlier discussed features. FIG. 4 depicts a typical joint detail showing two non-contacting abutting slabs 14 being joined. A backer rod 37 is installed at the base of the joint, generally by contracting personnel in the field. Most of the joint is filled with a non-shrink grout such as the previously mentioned CHRYSTEX (TM). This is depicted as element 34 in the drawing. Generally, a void is left in the top one inch of the joint 34, which is then filled with an elastomeric concrete such as POLYCRETE II (TM). FIG. 5 shows the FIG. 4 detail 31 in cross-section as well as the typical grout hole 22 and other previously mentioned elements. Hereinafter, grout holes 22 will be omitted from the elevational cross-sections in order to provide better clarity of illustration.

Figure 6:
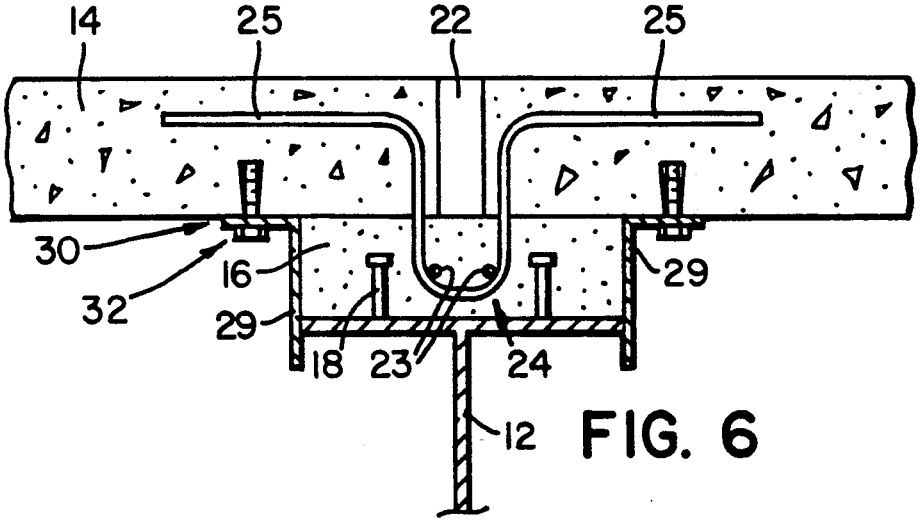
FIG. 6 is a cross sectional illustration of the basic invention-slab, joined to girder by use of slab protrusion and anchor studs in the haunch grout.
Figure 7:
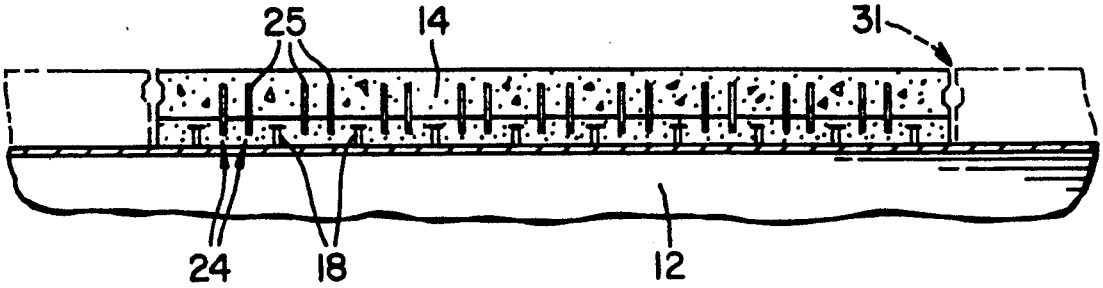
FIG. 7 is an elevational cross-section of the FIG. 6 embodiment.

One of the most important facets of my invention is the selection of grout-engaging devices which are anchored to or encased within the slab 14. It is these devices 24 that allow me to acquire much of the versatility that I have sought by this invention. Turning particularly to FIG. 6, one such grout engaging means is realized in the reinforcing bar 25 which protrudes from beneath the slab as a D ring or U-shaped projection 24. It may be seen how the grout haunch 16 securely captures the slab 14 to the girder 12 bolts 18 while isolating the slab and girder 12 (proper), from each other. As mentioned earlier, the adjustable mold side plates 29 do not enter into the shear equation since their purpose is strictly formational of the haunch mold and any frictional effect they exhibit on either the lateral portion of the girder 12 (upper portion) or the haunch 16 is minuscule. All other elements of the FIG. 6 representation have been previously noted in this disclosure with the exception of longitudinal reinforcement bars 23, an option. FIG. 7, the elevational cross-section relating to FIG. 6, depicts the relationship, as did FIG. 6, between the reinforcing bar 25 protrusions 24 and the girder bolts 18.

Figure 8:
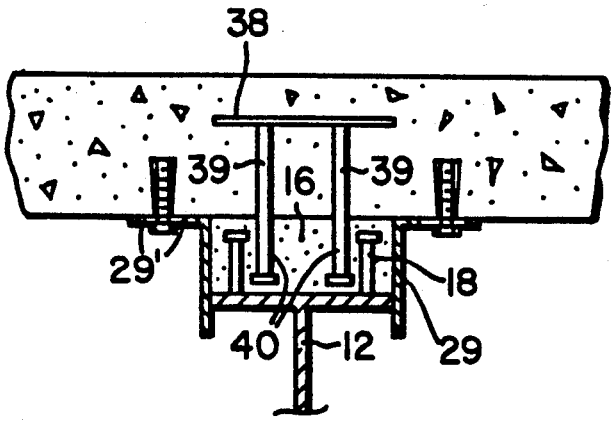
FIG. 8 is a cross-sectional illustration of yet another slab-encasted protrusion and the completed haunch area.
Figure 9:
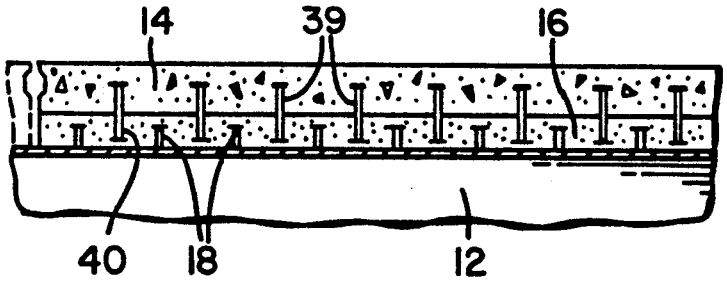
FIG. 9 is a elevational cross-section of the FIG. 8 embodiment.
Figure 10:
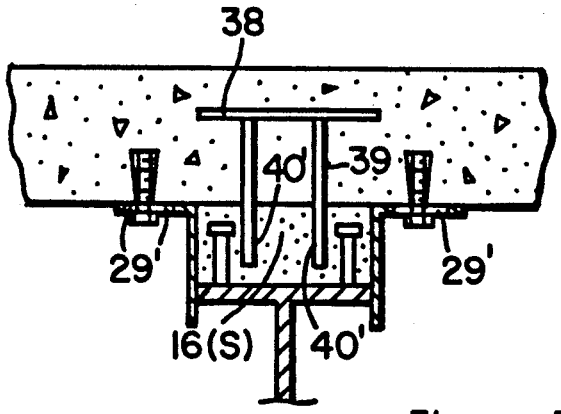
FIG. 10 is a cross-sectional illustration of the FIG. 8 embodiment, absent heads on the slab protrusions to facilitate easy removal of the slab.
Figure 11:
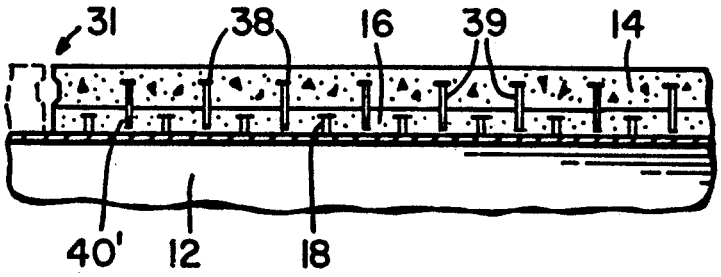
FIG. 11 is an elevational cross-section of the FIG. 10 embodiment.

Similar to the FIG. 6 embodiment, I have used the FIG. 8 alternative embodiment with a great deal of success. In this article, the slab encases a protruding stud 40 shear connector 38 which joins a pair of stud shafts 39, from which the protruding studs 40 depend the subsurface of the slab. The reader should note that the protruding stud devices 40 have heads similar to the ascending girder studs 18. These stud heads serve the same function as did the D ring or U projection 24 in the FIG. 6 embodiment. All other features of the slab and support structure subsystems that are depicted in FIG. 8 have been previously discussed. I have chosen to highlight the haunch plate slots 29' in a somewhat exaggerated detail in order to reinforce my teaching on this particular member. As with the earlier elevational cross sections, FIG. 9 depicts the salient elements of the preceding FIG. 8. Final to my disclosure and perhaps one of the most useful features herein is the alternate slab stud embodiment 40'. The elements of FIG. 10 and 11 are practically identical to those depicted in FIGS. 8 and 9, respectively. However, in FIG. 10, I have depicted the alternate embodiment wherein headless studs 40' are employed. This has no affect on the structural shear equation (function) of the embodiment as it appears in the field. Additional to the headless morphology, a bond breaker, well known in the industry, is applied to the length of the protruding (headless) portions 40' of the shear studs 39 before the haunch grout is pumped into the haunch area 16 (S). Thus, at a time for changeout of the slab, this device allows an ease of removal that makes it highly facilitative in temporary or detour bridges.

In my disclosure of just the preferred embodiments of my invention, I have put forth that which has, in my experience, proved of significant value. Practice with the invention will lead to alternate embodiments and perhaps more useful improvements in this art. Such endeavor is commended to those who might practice it consistent with the hereinafter appended claims.

What is claimed is:

1. A precast, quadrilaterally shaped slab having disposed therein at least one adjusting screw means proximate each of an end thereof, said slab having demarcated on the underside thereof at least one haunch region characterized by at least two protruding and downwardly depending flat elongate legs of right angled plates that are parallel and spacedly disposed to each other and are fixedly adjustable on, and relative to, said underside by the capture of a portion of each plate proximate slab-contacting surfaces of said plates by slab-anchored bolts, said region also characterized by at least one rigidly fixed grout-engaging means which depends downwardly from the slab between said plates and further characterized by at least one orifice which communicates the region with a top surface of the slab.

2. The article of claim 1 wherein rigidly fixed grout-engaging means comprises a U-shaped projection.

3. The article of claim 1 wherein rigidly fixed grout-engaging means comprises at least one protruding shear stud.

4. A precast, quadrilaterally shaped slab having disposed therein at least one adjusting screw means proximate each of a corner thereof, said slab having demarcated on the underside thereof at least one haunch region characterized by at least two protruding and downwardly depending flat elongate legs of right angled plates that are parallel and spacedly disposed to each other and are fixedly adjustable on, and relative to, said underside by the capture of a planar portion of each plate proximate a plurality of slots in slab-contacting surfaces of said plates by slabanchored bolts, said region discretely and further characterized by a rigidly fixed grout-engaging means which depends downwardly from the slab between said plates, which region communicates through an orifice to a top surface of the slab.

5. The article of claim 4 wherein said plates further comprise a leg of an L shaped or right-angled, flat elongate bracket, the other leg of which faces outwardly of said region, contacts the slab underside and is removably and adjustably securable thereon by slab/anchored bolts which pass therethrough at a plurality of transverse slots in said slab contacting surface.

6. The article of claim 5 wherein rigidly fixed grout-engaging means comprises a U-shaped projection.

7. The article of claim 5 wherein rigidly fixed grout-engaging means comprises at least one protruding shear stud.

* * * * *